US010798488B2

(12) United States Patent
Gunnarsson

(10) Patent No.: US 10,798,488 B2
(45) Date of Patent: Oct. 6, 2020

(54) DEVICE FOR REPRODUCING SOUND

(71) Applicant: Sound Dimension AB, Karlstad (SE)

(72) Inventor: Fredrik Gunnarsson, Karlstad (SE)

(73) Assignee: Sound Dimension AB, Karlstad (SE)

( * ) Notice: Subject to any disclaimer, the term of this patent is extended or adjusted under 35 U.S.C. 154(b) by 32 days.

(21) Appl. No.: 15/128,543

(22) PCT Filed: Mar. 24, 2015

(86) PCT No.: PCT/SE2015/050353
§ 371 (c)(1),
(2) Date: Sep. 23, 2016

(87) PCT Pub. No.: WO2015/147737
PCT Pub. Date: Oct. 1, 2015

(65) Prior Publication Data

US 2018/0192196 A1 Jul. 5, 2018

(30) Foreign Application Priority Data

Mar. 26, 2014 (SE) ..... 1450350
Dec. 2, 2014 (SE) ..... 1451466

(51) Int. Cl.
*H04R 5/04* (2006.01)
*H04R 3/12* (2006.01)
(Continued)

(52) U.S. Cl.
CPC ..... *H04R 5/04* (2013.01); *H04R 1/02* (2013.01); *H04R 3/12* (2013.01); *H04R 29/002* (2013.01);
(Continued)

(58) Field of Classification Search
CPC ..... H04R 5/04; H04R 3/12; H04R 29/002; H04R 2420/03; H04R 2420/05; H04R 1/02; H04S 7/301
(Continued)

(56) References Cited

U.S. PATENT DOCUMENTS 8,401,475 B2 * 3/2013 Kalanithi ..... H04B 5/0043 455/41.1
2007/0160225 A1 * 7/2007 Seydoux ..... H04W 8/005 381/79
(Continued)

FOREIGN PATENT DOCUMENTS

EP 1 729 541 A1 12/2006
EP 1 906 707 A1 4/2008
(Continued)

OTHER PUBLICATIONS

Digi International, "XBee/Xbee-PRO RF Modules Product Manual v1.xEx—802.15.4 Protocol", Sep. 23, 2009, Digi International Inc., pp. 1-69.*

*Primary Examiner* — Davetta W Goins
*Assistant Examiner* — Daniel R Sellers
(74) *Attorney, Agent, or Firm* — Blank Rome LLP

(57) ABSTRACT

The present invention relates to a first device for reproducing sound, said first device having a housing and including: —at least one loudspeaker element for reproducing sound, —first signal processing means for processing a first input signal, to provide a processed signal for reproduction by said least one loudspeaker element. The first device further includes: —means for, in use, detecting if there is a presence of at least one second device for reproducing sound, and, —said processing means being arranged to process said first input signal based on the result of said detection of presence, so as to provide a processed signal being dependent on said
(Continued)

detection of presence to said at least one loudspeaker element. The invention also relates to a system for reproducing sound.

23 Claims, 3 Drawing Sheets

(51) Int. Cl.
*H04R 1/02* (2006.01)
*H04S 7/00* (2006.01)
*H04R 29/00* (2006.01)

(52) U.S. Cl.
CPC ..... *H04S 7/301* (2013.01); *H04R 2420/03* (2013.01); *H04R 2420/05* (2013.01)

(58) Field of Classification Search
USPC ..... 381/304, 81, 85, 123
See application file for complete search history.

(56) References Cited

U.S. PATENT DOCUMENTS

| | | | | |
|---|---|---|---|---|
| 2007/0286436 | A1 | 12/2007 | Isobe et al. | |
| 2009/0214051 | A1 | 8/2009 | Lockett et al. | |
| 2009/0245523 | A1 | 10/2009 | Harris | |
| 2010/0177909 | A1* | 7/2010 | Aarts | H04R 1/403 381/92 |
| 2012/0002827 | A1* | 1/2012 | Oshitani | H04S 7/30 381/300 |
| 2012/0250894 | A1 | 10/2012 | Bourgoin et al. | |
| 2014/0003619 | A1 | 1/2014 | Sannie et al. | |
| 2014/0219481 | A1* | 8/2014 | Lin | H04R 3/12 381/300 |
| 2015/0104037 | A1* | 4/2015 | Lee | H04R 27/00 381/80 |

FOREIGN PATENT DOCUMENTS

| | | | |
|---|---|---|---|
| EP | 1 909 531 | A1 | 4/2008 |
| WO | WO 2008/029478 | A1 | 3/2008 |
| WO | WO 2014/122550 | A1 | 8/2014 |

* cited by examiner

DEVICE FOR REPRODUCING SOUND

FIELD OF THE INVENTION

The present invention relates to sound reproduction systems, and in particular to sound a reproduction system comprising a device having at least one loudspeaker element for reproducing sound and signal processing means for providing a signal for reproduction by said least one loudspeaker element.

BACKGROUND OF THE INVENTION

There exist various kinds of sound reproduction systems, and sound reproduction systems are often designed for a specific purpose.

For example, the functionality of sound reproduction systems can rely on a configuration where a pair of spaced apart loudspeaker units are used to reproduce sound to be experienced by one or more listeners, where the sound to be reproduced emanates from an input signal, such as an audio stereo signal.

Systems of the above kind are often suitable for use e.g. in semi-permanent set-ups such as, for example, in living rooms or other suitable locations at a user's premises. Systems utilising two spaced apart loudspeaker units can also be of a design facilitating portability, but as is realized, use of systems comprising separate components inherently imposes inconvenience in regard of portability.

With specific regard to portable sound reproduction systems, these are often, e.g. for convenience in portability, designed as single units, and hence with e.g. left and right output channels being reproduced by separate loudspeaker elements enclosed in common housing, thereby forming a single unit. These units are often limited in size to further enhance portability.

SUMMARY OF THE INVENTION

It is an object of the present invention to provide a device for reproducing sound that allows for sound reproducing configurations that can be adapted for different situations in a straight forward manner.

According to the present invention, it is provided a first device for reproducing sound, said first device having a housing and including:

- at least one loudspeaker element for reproducing sound,
- first signal processing means for processing a first input signal, to provide a processed signal for reproduction by said least one loudspeaker element. The first device further includes:
- means for, in use, detecting if there is a presence of at least one second device for reproducing sound, and,
- said processing means being arranged to process said first input signal based on the result of said detection of presence, so as to provide a processed signal being dependent on said detection of presence to said at least one loudspeaker element.

There exist a number of applications where it can be desirable to have customized speaker systems. For example, sound reproduction systems can, apart from the examples given above, be specifically designed for home theater systems, gaming systems and various other indoor and outdoor entertainment systems where demands imposes different demands.

Portable sound reproducing devices are often compact and lightweight, which inherently provides limitations with regard to the capabilities of reproducing sound. As a result portable sound reproduction systems in general do not provide a listening experience that can be compared with stationary high-end sound reproduction systems.

The present invention provides a modular sound reproduction system that is not only easy to install, but that is also easy to adapt to a variety of situations, needs and desires. This is accomplished by means of a device for reproducing sound that is provided with means for detecting presence of at least one second device for reproducing sound, and where a first input signal for being reproduced by said device is processed based on the result of the possible detection of presence of other devices.

If no other devices are detected, the device according to the present invention functions as a stand alone unit, whereas if one or more further devices are detected, the reproduction of sound is controlled such that the one or more further devices are taken into consideration. Similarly, the other devices can be arranged to do the same with regard to playback of sound, and as result the two or more devices can act in unison as a single unit, where different devices can be arranged to reproduce different signals, where the different signals still can stem from one and the same input signal, so as to in combination reproduce said input signal acting as a single unit.

The devices can be arranged to process said first input signal based on the relative location in relation to the one or more devices that a device is being stacked together with. For example, if a plurality of devices are being stacked together to reproduce a first channel of a multi-channel signal, the devices can be arranged to reproduce said first channel signal in dependence of the presence of devices on top, below, to the right, or to the left of the device, respectively, where said one or more other devices being present can also be arranged to reproduce said first channel signal.

Consequently, the present invention provides a system that allows a device according to the invention to be portable, while at the same time the device can form part of a system including a number of devices, thereby forming a high-end system.

The devices can further be provided with means for automatically aligning when put together. For example, the device can be provided with corresponding engagement means such as gripping means or other suitable means by the use of which automatic alignment is obtained. Automatic alignment can also be arranged to be accomplished, for example, by means of magnets. According to one embodiment, the device is arranged such that it detects presence of said at least one second device only when said second device is aligned with said first device.

For example, sensors means, such as e.g. IR sensor means, can be used to detect presence of another device, where the sensor means can be arranged such that proper function is only achieved when the devices are properly aligned. According to one embodiment two or more sensor means on a single surface, such as a top, bottom, front, back or side surface, are used to detect presence/ensure alignment, where two or more surfaces of the device can be provided with a plurality of sensors.

According to one embodiment, the device is arranged such that presence of at least one second device is only detected when the devices contact each other, or when a distance between the device and said second device is within a first distance. This distance can, for example, be a distance in any one of the ranges: 0-100 mm, 0-50 mm, 0-20 mm, 0-10 mm.

Consequently, a system comprising a number of devices of the disclosed kind can be used, where a plurality of devices can be stacked together to reproduce a first channel of a multi-channel input signal. The devices being stacked together can be arranged to change reproduction of said first channel when a device of said devices is removed, or when a new device is added to the stack.

Further, a first plurality of devices according to the above can be arranged to reproduce a first channel of a multi-channel signal, and a second plurality of devices according to the above can be arranged to reproduce a second channel, being different from said first channel, of said multi-channel signal. Consequently, separate stacks of devices can be used for different channels of a multi-channel signal, where the stacks can be spaced apart from each other.

Further features of the present invention and advantages thereof will become clear from the following detailed description of illustrative embodiments and from the attached drawings.

BRIEF DESCRIPTION OF DRAWINGS

The invention will now be described in greater detail with reference to the drawings, wherein.

DESCRIPTION OF EXEMPLARY EMBODIMENTS

As was mentioned above, the present invention relates to a modular sound reproducing system, where a plurality of sound reproducing devices can be combined to reproduce sound from an input signal as a single unit.

Figure 1:
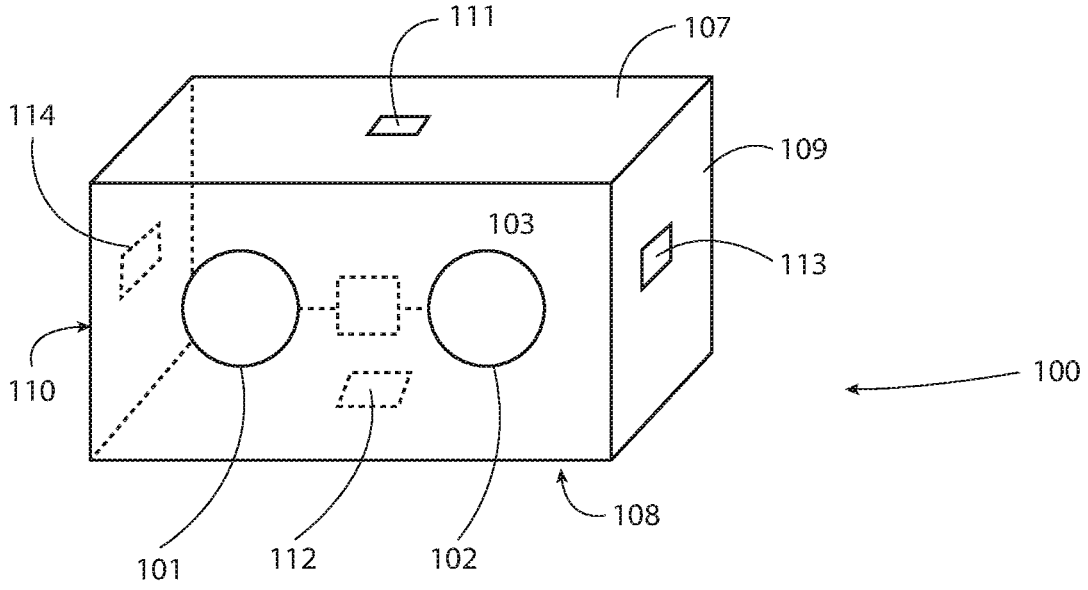
FIG. 1 discloses a first exemplary embodiment of a device for reproducing sound according to the present invention.

FIG. 1 discloses a first exemplary embodiment of a device 100 for reproducing sound according to the present invention. The device 100 is a sound reproducing unit having a housing including left loudspeaker element 101 and a right loudspeaker element 102 for, for example, reproducing a left channel audio-stereo sound and a right channel audio-stereo sound, respectively. The device 100 further comprises a signal processor 103, which provides a left channel output signal 104 and a right channel output signal 105 by signal processing an input signal.

The signal processor 103 can be arranged to receive the input signal, such as e.g. an audio stereo signal by any suitable means, e.g. via a Bluetooth connection, a Wi-Fi connection or any other suitable wireless connection. For example, the device 100 can be arranged to receive the input signal from a portable device such as a mobile phone, smart phone, tablet computer, laptop/notebook computer MP3 player or any other suitable device.

The device 100 can also be provided with physical connection means for connecting a sound signal source to the device 100 by means of a wire connection. Such physical connection means include HDMI interface, wired network connection, USB or other computer bus connection. The device 100 can also be provided with e.g. a memory card reader for receiving memory cards having sound to be reproduced stored thereon. According to one embodiment, the device 100 includes a built-in sound signal source, such as, e.g., a radio receiver or a CD, DVD and/or BD disc player. As will be described below, the device 100 also includes further means for communicating a signal to be reproduced.

The loudspeaker elements 101, 102 are, in the present example, arranged on a front surface 106 of the device 100 in a conventional manner. The housing of the device 100 further comprises, when put on a horizontal surface in a position for use, a top surface 107, a bottom surface 108, a right side surface 109 and a left side surface 110. According to the disclosed embodiment, each of the top surface 107, bottom surface 108, right side surface 109 and left side surface 110 comprises a sensor 111-114, respectively. However, according to one embodiment, only one of the said surfaces are provided with a sensor, and according to another embodiment only some of the said surfaces are provided with sensor means. The sensors 111-114 are used to detect presence of further sound reproducing devices. The sensors 111-114 can, for example, consist of IR (infrared) sensors being able to communicate with corresponding IR-sensors of other devices.

Figure 2:
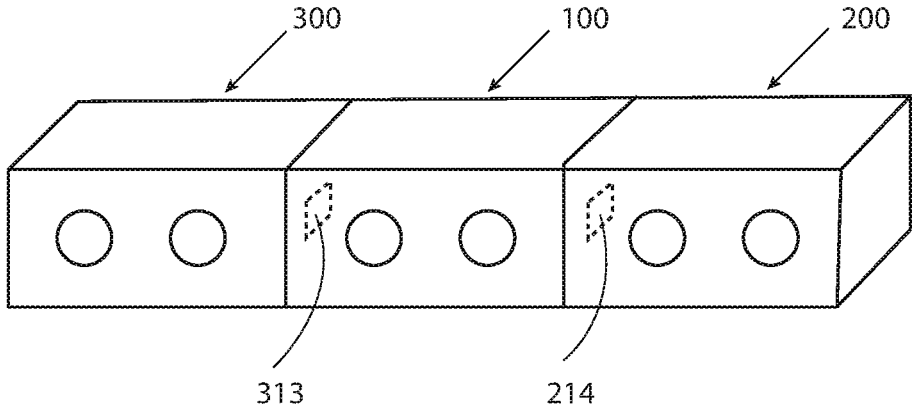
FIG. 2 shows a plurality of devices according to the present invention acting together.

This is illustrated in FIG. 2. FIG. 2 shows the device 100 of FIG. 1 as well as a device 200 arranged to the right of device 100 and a device 300 arranged to the left of device 100. The devices 200, 300 are provided with sensors in a similar manner as the device 100 and, in this example, sensor 113 of device 100 can be arranged to communicate with a corresponding sensor 214 of device 200, and sensor 114 of device 100 can be arranged to communicate with sensor 313 of device 300.

The signal processor 103 or, alternatively, other suitable processing means arranged in the device 100, communicates with each of the sensors 111-114 and controls communication using these sensors. For example, the sensors 111-114 can be arranged to perform transmissions at regular intervals to allow detection of the device 100, e.g. by devices 200, 300. The sensors of the devices 200, 300, and similarly the sensors of device 100, detect incoming IR signals, and when detecting an incoming IR signal, communication can be initiated to determine whether the detected signal stems from a compatible device.

For as long as other devices are not detected, the device 100 will act as if there is no other device present, and the signal processor 103 will process the input signal based on this situation, and thereby process the output signal for reproduction by elements 101, 102 only, i.e. the device 100 acts as a stand alone unit. In this mode, the unit 100 can function as any standard portable unit replaying e.g. the two channels of a left and right stereo signal.

If, on the other hand, e.g. sensor 113 receives a transmission from sensor 214 of device 200 in FIG. 2, the signal processor 112 will, following suitable signaling/communication, obtain knowledge of the fact that there is second device present, and also the location of device 200 in relation to device 300, established by the fact that the sensor 113 is performing the communication. Similarly, when sensor 114 receives a response from sensor 313 of device 300, the signal processor 103 will receive knowledge of the presence, and relative location, of device 300. Similarly, further devices can be arranged e.g. below as well as on top of device 100. Further examples will be described below.

When the signal processor 103, by means of the sensors, detects presence of one or further devices, the input signal will be processed on the basis of this presence, and the signals provided to loudspeaker elements 101, 102 will be dependent on the presence of other devices. Similarly, this will also be performed by other devices, e.g. devices 200, 300, in the configuration.

When signal processor 103 detects presence of one or more further devices it can be arranged to communicate with the one or more further devices to receive information regarding the "world" as seen from these devices. That is, the device will communicate its status with regard to possible contact with further devices. In the present example, device 100 will communicate the detected presence of device 200 to device 300, and, conversely, the detected presence of device 300 to device 200 so that the devices 200, 300 will also be able to determine the current device configuration.

In this way, each device of a particular configuration can be made aware of any other device in the configuration and its location. With regard to the present invention, it is contemplated that any number of devices are used, and irrespective of the number of devices that are used the complete configuration of all devices can be deduced in a straight forward manner by each device communicating detected presence of other devices, and the relative location of other devices, where this relative location can be determined by the position of the sensor communicating with another device.

Further, in a similar manner, it can be determined which of the devices that is provided with an input signal for being reproduced by the loudspeaker elements. If the input signal is received or present by a single device, such as e.g. device 100, this device can be arranged to communicate the input signal that is to be reproduced by means of the communication interface that has been established by means of the sensors. With regard to the IR-interface, for example, such interfaces are capable of communicating high amounts of data, and e.g. CD quality sound can be communicated by means of an IR interface. Consequently, the IR interface is suitable e.g. for communicating an audio-stereo signal to be reproduced by the other devices. The IR interface further has the advantage that the use of an IR interface is suitable also with regard to timing, that it is it can be ensured that the input signal to be reproduced can be received simultaneously or substantially simultaneously by all devices without undesired delay, to be reproduced in a synchronized manner.

According to one embodiment, the input signal is communicated to all devices participating in the configuration whereby the signal processor of each of the devices calculates suitable signals for its loudspeaker elements, respectively, to be reproduced. Since the signal processor of a particular device is aware of its position in the configuration, the signal processor can be arranged to use an algorithm taking the position into account for calculating suitable signals to be reproduced based on its position in the configuration.

For example, device 300 can be arranged to reproduce a left channel signal and device 200 can be arranged to reproduce a right channel signal, while device 100 can be arranged to reproduce e.g. a centre channel signal or both a left and a right channel signal. Consequently, when being a stand alone device, a device can be arranged to reproduce a plurality of channels of a multi-channel input signal, such as the left and right signal of a two-channel stereo signal, while when forming part of a multi-device setup, the same device can be arranged to reproduce e.g. only one channel, or any other suitable channel reproduction.

As is realized, the algorithms can be considerably more advanced, and the signal processors can be arranged to calculate suitable signals for each loudspeaker element, respectively. According to one embodiment, the signal processors are provided with suitable parameters for use when calculating signals to be provided to the loudspeaker elements, where parameters can be stored for a large number of device configurations and where the device configurations can be arranged to include everything from e.g. a single device to, in principle, any number of devices.

The present invention, consequently, has the advantage that a single device can be used as a single unit with the limitations that are normally present with regard to relatively small devices. The same device can, however, be used also in larger configurations, such as e.g. a number of devices being stacked on top of each other to thereby act as a single unit, mimicking a considerable larger loudspeaker device. This means that e.g. a user of the system can be in possession of a number of devices which can form part of e.g. a high-end stereo reproduction system with high performance due to the number of devices. At the same time one or more of these devices can be separated from the high end system e.g. to be brought when travelling to function as portable devices. As is realized, the present invention provides a high degree of freedom with regard to configuration, and the system allows that a configuration of suitable size can be obtained for any particular situation. Furthermore, a plurality of users can each be in the possession of one or more devices according to the present invention, and when gathering together the devices can be stacked together in any suitable configuration to automatically provide a very powerful system while at the same time little effort is required from each of the persons in the gathering.

Figure 3:
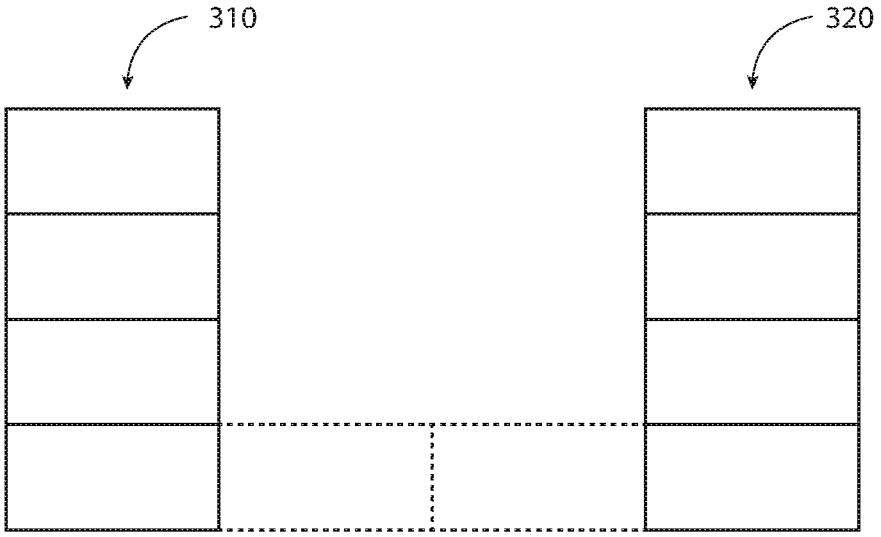
FIG. 3 shows another example of a plurality of devices according to the present invention acting together.

As is realized, e.g. with regard to larger home systems, it can be desired to stack a number o units in separate stacks e.g. as a right channel stack and a left channel stack. This is illustrated in FIG. 3, where two stacks 310, 320 each comprising four devices are shown. In such situations, the IR-interface will work perfectly fine for identifying devices in a single stack, such as devices of stack 310 or of stack 320, while this will not solve the problem of the stacks 310, 320 becoming aware of each other. For this reason, the devices can be further provided with suitable means for allowing wireless communication between the stacks and/or e.g. a wire for providing suitable connection to allow the stacks becoming aware of each other. In this case some further input may be required, e.g. to inform the stacks whether they are to be e.g. right channel speakers, left channel speakers, center channel speaker, rear channel speakers etc. In this case, further information can be required e.g. by manually setting a suitable switch or by wiring two devices together in a manner that automatically allows this to be determined.

For example, either the left channel or the right channel can be arranged to always be master, so that e.g. a line out from one of the devices of the master stack will automatically tell the other stack whether it is to play right channel or left channel. As is realized, it is only required that one of the devices of stack 310 is in communication with one of the devices of stack 320. The above also applies with regard to the signal that is to be reproduced, which consequently can either be communicated wirelessly or by means of wire.

According to one embodiment, the left channel stack and right channel stack are connected by intermediate devices, indicated by dashed line devices 331-333, in which case no further information is required, since all devices will be able to deduce their relative position in relation to the other devices.

With regard to the sensor means, the device 100 shown in FIG. 1 has been provided with a single sensor on each side of the device. It is also contemplated that a plurality of sensors are arranged on each side so that a plurality of sensors can be used to determine that abutting devices are aligned to a suitable extent, e.g. to ensure front surfaces of the various devices being flush with each other, or aligned in another suitable way. In this case, it can be required that communication is established between two devices using at least two or more sensors in order to pair the devices.

Further, the sensoring means can be arranged such that presence of another device is only detected if the distance between the devices is less than some suitable distance, such as, for example, a distance in the range 0-100 mm, 0-50 mm, 0-20 mm, 0-10 mm. Also, the sensoring means can be arranged such that presence of another device is only detected if the devices are close enough to contact one another.

Alternatively, the devices can, for example, be provided with means for automatically aligning the devices to each other so that communication is made possible only when the devices are aligned to each other to a desired extent. The above distance requirements regarding the distance between aligned devices can still be arranged to be applied. Obviously, in general, the devices will be designed such that the devices physically contact each other. For example, the devices can be arranged to be provided with engagement means for mutual engagement with complementary engagement means of the second device. Such engagement means can consist of any known suitable means for fixing two devices together in a releasable manner. In this way, the devices can be automatically aligned by means of the engagement means.

Furthermore, so far the invention has been described for devices having similar size. It is also contemplated that devices of different sizes can be used. For example, a larger device can be arranged to mainly reproduce low frequencies, while smaller devices can be arranged to reproduce higher frequencies. For this reason, the communication between devices can, in addition, provide identification regarding the type of device that it represents. In this way, an accurate configuration can still be determined even if a large number of devices having varying sizes are used, and where sensor means can be used to establish the relative location of the devices in relation to each other. The devices can e.g. be provided with sizes being of different multiples of each other in various directions.

Figure 4A:
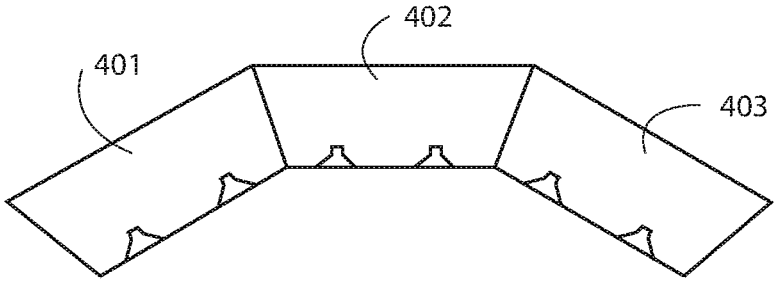
FIGS. 4A-B shows further examples of a plurality of devices according to the present invention acting together.
Figure 4B:
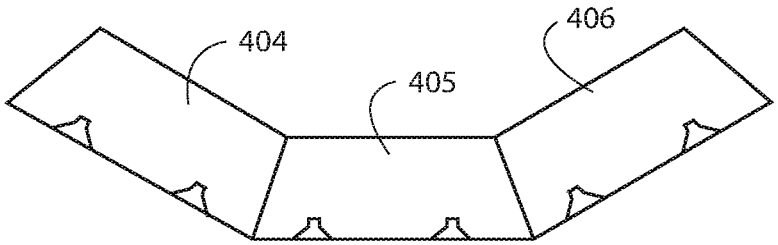

The present invention also allows for more complex configurations. For example, the side surfaces can be arranged at angles other than right angles with regard to the front surface to thereby allow configurations that are e.g. convex or concave in appearance. This is illustrated in FIGS. 4A-B for a three device set up with devices 401-403, and 404-406, respectively, where the devices are seen from above with loudspeaker elements schematically indicated.

Also, the devices can be designed for reproduction of different frequency ranges, for example, a device can be designed to reproduce low (bass) frequencies, e.g. constituting a single loudspeaker element. Similarly, different devices can be arranged to reproduce, with regard to sound reproduction, e.g. mid and/or high frequencies.

Furthermore, with regard to control of the reproduction of sound by the individual units this can, as mentioned above, be arranged to be controlled individually by each device using information of the position of the device in the configuration. Alternatively, one of the devices can be arranged to be a "master"-device which assigns tasks to the other devices e.g. to play left channel, right channel, bass etc. For example, the device to which the input signal is being made available can be arranged to be automatically selected as master. Alternatively, the device in any particular location of the configuration can be arranged to be selected as master or randomly or in any other suitable way.

If one of the devices is disconnected from the system this will immediately be known to the other devices so that recalculation of signals to be reproduced can be immediately performed. With regard to a number of devices being stacked in a vertical stack for reproducing e.g. left channel sound as in FIG. 3, some devices can be arranged to play high frequency signals, some to play mid frequency signals and some to play low frequency signals.

Further, according to one embodiment, the devices can be provided with sensor means for determining presence of further devices, and where communication between the devices is performed using other means. For example, communication between devices can be arranged to be performed using NFC (Near Field Communication), or other suitable wireless communication, while IR sensors or other sensors are used to determine presence of the further devices and also the relative location of further devices. Any kind of suitable sensors can be used, such as, e.g. magnetic sensors. One or more magnetic sensors can be arranged e.g. on one or more sides of the device, and these can be arranged to detect presence and relative location of other devices by detecting corresponding magnetic means of these other devices. The use of magnets can also be arranged to provide automatic alignment. For example, magnets can be arranged to attract corresponding magnets of a second device, such that the devices, when put together, will be "drawn" into position by means of the magnets to thereby be aligned. Any suitable number of magnets on a side of the device can be used, e.g. 1, 2, 3 or more. It is also possible to use e.g. magnetic sensors for determining relative location of devices, while communication is performed e.g. using IR.

Finally, it should be understood that the present invention is not limited to the embodiments described above, but relates to and incorporates all embodiments within the scope of the appended independent claims.

The invention claimed is:

1. A first device for reproducing sound, said first device having a housing and including:

at least one loudspeaker element for reproducing sound, first signal processing means for processing a first input signal, to provide a processed signal for reproduction by said least one loudspeaker element, means for, in use, detecting if there is a presence of at least one second device for reproducing sound, and, means for, when detecting the presence of at least one second device for reproducing sound while reproducing sound, detecting whether the position of said at least one second device is such that a surface of said second device is substantially aligned with a surface of said first device, said first device being arranged to detect presence of said at least one second device only when said second device is substantially aligned with said first device, said processing means being arranged to process said first input signal based on the result of said detection of presence, without user interaction, so as to provide a processed signal being dependent on said detection of presence to said at least one loudspeaker element, and when detecting presence of at least one second device and a third device for reproducing sound, communicating information relating to said presence of said third device to said second device, and communicating information relating to said presence of said second device to said third device.

2. A first device for reproducing sound according to claim 1, wherein said processing means is arranged to process said first input signal based on said relative location of said at least one second device in relation to said first device.

3. A first device for reproducing sound according to claim 1, said device further including means for, when reproducing a first channel of a multichannel input signal:

reproducing said first channel differently when detecting presence of said second device in comparison to when a second device is not detected.

4. A first device according to any claim 1, wherein said means for detecting presence of at least one second device constitutes sensor means.

5. A first device according to claim 4, wherein said sensor means is arranged on a surface of said first device.

6. A first device according to claim 4, wherein said sensor means is arranged to allow communication with at least one second device.

7. A first device according to claim 4, wherein at least one sensor means is infrared IR sensor means or magnetic sensor means.

8. A first device according to claim 1 wherein:

said means for detecting presence of at least one second device is arranged to detect presence of a second device only when a distance between said first device and said second device is within a first distance.

9. A first device according to claim 8, said first distance being a distance in any one of the ranges: 0-100 mm, 0-50 mm, 0-20 mm, 0-10 mm.

10. A first device according to claim 1, wherein:

said means for detecting presence of at least one second device is arranged to detect presence of said second device when said second device physically contacts said first device.

11. A first device according to claim 1, wherein said first device comprises means for communicating information relating to said presence of said third device and relative location of said third device to said second device, and/or communicating information relating to said presence of said second device and relative location device to said third device.

12. A first device according to claim 1, wherein said device includes means for:

when communicating with at least one second device, receiving information relating to other devices with which said second device is communicating, if any.

13. A first device according to claim 1, wherein said device including means for:

when receiving information relating to at least one further device, determining relative location of devices for which information is received.

14. A first device according to claim 1, wherein said housing at least comprises, when said first device is positioned on a horizontal surface in position intended for use, a top surface, a bottom surface, a front surface, a rear surface, and side surfaces, respectively, wherein:

one or more of said surfaces comprises sensor means for sensing presence of a second device.

15. A first device for reproducing sound according to claim 1, wherein said first device comprises a plurality of sensor means on at least one surface of said housing for detecting presence of at least one second device.

16. System for reproducing sound, based on a first input signal, wherein said system comprises a plurality of devices for reproducing sound according to claim 1.

17. System according to claim 16, wherein, each of said plurality of devices comprises means for, when communicating with a first device of said plurality of devices:

communicating information to said first device relating to other devices with which said device is communicating.

18. System according to claim 16, wherein each of said devices further includes means for, when reproducing a first channel of a multi-channel input signal:

reproducing said first channel differently when detecting presence of at least one other of said devices in comparison to when not detecting presence of at least one other of said devices.

19. System according to claim 16, wherein each of said devices further includes means for, when reproducing a channel of a multi-channel input signal:

reproducing said channel differently when detecting presence of at least one other of said devices in comparison to when not detecting presence of at least one other of said devices.

20. System for producing sound, comprising:

a first plurality of devices according to claim 1 arranged to reproduce a first channel of a multi-channel signal, and a second plurality of devices according to claim 1 arranged to reproduce a second channel, being different from said first channel, of said multichannel signal.

21. A first device for reproducing sound, said first device having a housing and including:

at least one loudspeaker element for reproducing sound, first signal processing means for processing a first input signal, to provide a processed signal for reproduction by said least one loudspeaker element, means for, in use, detecting if there is a presence of at least one second device for reproducing sound, and, means for, when detecting the presence of at least one second device for reproducing sound while reproducing sound, determining a relative location of said at least one second device in relation to said first device, said first device being arranged to detect the presence of said at least one second device only when said second device is substantially aligned with said first device, said first device being provided with means for automatically aligning with a second device provided with corresponding means for automatic alignment, said processing means being arranged to process said first input signal based on the result of said detection of presence, without user interaction, so as to provide a processed signal dependent on said detection of presence to said at least one loudspeaker element, and when detecting presence of at least one second device and a third device for reproducing sound, communicating information relating to said presence of said third device to said second device, and communicating information relating to said presence of said second device to said third device.

22. A first device for reproducing sound, said first device having a housing and including:

at least one loudspeaker element for reproducing sound, first signal processing means for processing a first input signal, to provide a processed signal for reproduction by said least one loudspeaker element, means for, in use, detecting if there is a presence of at least one second device for reproducing sound, and, means for, when detecting the presence of at least one second device for reproducing sound while reproducing sound, determining a relative location of said at least one second device in relation to said first device, said first device being arranged to detect the presence of said at least one second device only when said second device is substantially aligned with said first device, said first device being arranged to, when communicating with a second device, communicate information relating to the size of said first device to said second device, said processing means being arranged to process said first input signal based on the result of said detection of presence, without user interaction, so as to provide a processed signal dependent on said detection of presence to said at least one loudspeaker element, and when detecting presence of at least one second device and a third device for reproducing sound, communicating information relating to said presence of said third device to said second device, and communicating information relating to said presence of said second device to said third device.

23. A first device for reproducing sound, said first device having a housing and including:

at least one loudspeaker element for reproducing sound, first signal processing means for processing a first input signal, to provide a processed signal for reproduction by said least one loudspeaker element, means for, in use, detecting if there is a presence of at least one second device for reproducing sound, and, means for, when detecting the presence of at least one second device for reproducing sound while reproducing sound, determining a relative location of said at least one second device in relation to said first device, said first device being arranged to detect the presence of said at least one second device only when said second device is substantially aligned with said first device, said first device comprising engagement means for engaging corresponding engagement means of a second device, so as to, when engaged, releasably fix the position of said second device in relation to said first device, said processing means being arranged to process said first input signal based on the result of said detection of presence, without user interaction, so as to provide a processed signal dependent on said detection of presence to said at least one loudspeaker element, and when detecting presence of at least one second device and a third device for reproducing sound, communicating information relating to said presence of said third device to said second device, and communicating information relating to said presence of said second device to said third device.

* * * * *